US05131601A

United States Patent [19]

Okawa

[11] Patent Number: 5,131,601

[45] Date of Patent: Jul. 21, 1992

[54] VERTICAL IMPACT CRUSHER

[75] Inventor: Koji Okawa, Takasago, Japan

[73] Assignee: Kabushiki Kaisha Kobe Seiko Sho, Kobe, Japan

[21] Appl. No.: 706,208

[22] Filed: May 28, 1991

[30] Foreign Application Priority Data

Aug. 31, 1990 [JP] Japan ..... 2-231915

[51] Int. Cl.[5] ..... B02C 19/00

[52] U.S. Cl. ..... 241/275

[58] Field of Search ..... 241/275, 300

[56] References Cited

U.S. PATENT DOCUMENTS

| | | | |
|---|---|---|---|
| 3,032,169 | 5/1962 | Bridgewater | 241/275 |
| 4,586,663 | 5/1986 | Bartley | 241/197 |
| 4,784,339 | 11/1988 | Deffenbaugh | 241/275 |
| 4,787,564 | 11/1988 | Tucker | 241/275 |
| 4,834,298 | 5/1989 | Murata et al. | 241/5 |
| 4,871,119 | 10/1989 | Murata et al. | 241/189 R |

FOREIGN PATENT DOCUMENTS

| | | | |
|---|---|---|---|
| 0187252 | 7/1986 | European Pat. Off. | 241/300 |

*Primary Examiner*—Mark Rosenbaum
*Assistant Examiner*—John M. Husar
*Attorney, Agent, or Firm*—Oblon, Spivak, McClelland, Maier & Neustadt

[57] ABSTRACT

A vertical impact crusher comprises a rotor supported for rotation at a high rotating speed about a vertical axis, and having discharge gates through which a material fed into the rotor is discharged for crushing. Each discharge gate is provided in one side thereof with a pair of hard chips provided respectively with cemented carbide chips and stacked one over the other so as to be replaced with each other. Each hard chip has upper and lower portions projecting in the direction of rotation of the rotor, and each cemented carbide has upper and lower portions projecitng in the direction of rotation of the rotor. The hard chips provided respectively with the cemented carbide chips are replaced with each other after the working surfaces of the hard chips and the cemented carbide chips have been abraded to some extent. The surfaces of the new hard chips and the new cemented carbide chips are formed so as to guide the flow of the material toward the upper and lower portions of the stack of the hard chips and the cemented carbide chips so that the recesses formed between the upper and lower portions of the hard chips and the cemented carbide chips are abraded more intensively than the middle portion of the stack of the hard chips and the cemented carbide chips in the initial stage of use and so that the middle portion of the stack is abraded more intensively than the upper and lower portions of the stack after the mutual replacement of the hard chips together with the cemented carbide chips.

2 Claims, 5 Drawing Sheets

VERTICAL IMPACT CRUSHER

BACKGROUND OF THE INVENTION

1. Field of the Invention

The present invention relates to a vertical impact crusher for crushing pieces of ore or adjusting the grain size of ore and, more particularly, to a vertical impact crusher having a rotor provided with improved, durable hard chips at its discharge gates.

2. Description of the Related Art

An exemplary vertical impact crusher pertinent to the present invention will be described with reference to FIGS. 5 to 8. As shown in FIG. 5, a vertical impact crusher 1 comprises a vertical drive shaft supported for rotation by a bearing unit 38, a rotor 2 mounted on the vertical drive shaft, a feed device 10 disposed in its upper central portion, and a hopper 11 disposed over the feed device 10. As shown in FIGS. 6, 7 and 8, the rotor 2 is a generally cylindrical box comprising a top rotor disk 7, a bottom rotor disk 8, three side walls arranged between the top rotor disk 7 and the bottom rotor disk 8 at intervals so as to form discharge gates therebetween, top liners 3 attached to the inner surface of the top rotor disk 7, bottom liners 4 attached to the inner surface of the bottom rotor disk 8, a central distributor 9 fixedly provided on the bottom rotor disk 8, three blades 12 arranged at equal angular intervals on the inner surface of the side walls 13 so as to extend radially inward, and three gate blocks 14 each disposed contiguously with one vertical edge of the side wall 13. Dead stock 15 of the material is formed in spaces each formed by the blade 12, the gate block 14 and the side wall 13 during the rotation of the rotor 2. As shown in FIGS. 8 and 9, abrasion resistant hard chips 5*a* and 5*b* are attached detachably and one over the other to the extremities of the gate blocks 14, respectively. Cemented carbide chips 21*a* and 21*b* of a hardness higher than that of the hard chips 5*a* and 5*b* are embedded in the edges of the hard chips 5*a* and 5*b*, respectively.

When the rotor 2 is rotated at a high rotating speed on the vertical drive shaft, the material fed through the feed device into the rotor 2 is caused to flow along the dead stock 15 and the hard chips 5*a* and 5*b* and is discharged through the gates 16 by centrifugal force as shown in FIG. 6. Then, the material collides against anvils 17 or a dead ring, not shown, and is crushed into grains of desired grain sizes.

During the rotation of the rotor 2 of the conventional vertical impact crusher 1 at a high rotating speed, the material flowing along the dead stock 15 tends to flow further toward the middle portion of the vertical stack of the hard chips 5*a* and 5*b* as indicated by an arrow in FIG. 11(*b*). Consequently, the new hard chips 5*a* and 5*b*, and the new cemented carbide chips 21*a* and 21*b* having shapes as shown in FIGS. 10(*a*) and 11(*a*) are abraded with time in shapes as shown in FIGS. 10(*b*) and 11(*b*); that is, the lower portions $d_1$ of the upper hard chip 5*a* and the upper cemented carbide chip 21*a*, and the upper portions $d_2$ of the lower hard chip 5*b* and the lower cemented carbide chip 21*b* are abraded. Then, to use further the thus abraded hard chips 5*a* and 5*b*, and the thus abraded cemented carbide chips 21*a* and 21*b*, the hard chips 5*a* and 5*b* provided respectively with the cemented carbide chips 21*a* and 21*b* are replaced on each gate block 14 with each other to stack the hard chips 5*a* and 5*b* on each gate block 14 as shown in FIGS. 10(*c*) and 11(*c*), in which the stack of the abraded hard chips 5*a* and 5*b* has a central portion in which the flow of the material is concentrated thicker than in upper and lower portions. The replacement of the hard chips 5*a* and 5*b* with each other enables the further use of the abraded hard chips 5*a* and 5*b* and the abraded cemented carbide chips 21*a* and 21*b*.

However, since the section of the surface of the stack of the abraded hard chips 5*a* and 5*b* provided with the abraded cemented carbide chips 21*a* and 21*b* is a smooth curve falling uniformly from the middle portion toward the upper and lower ends as shown in FIG. 10(*c*) and the shape of a portion of the dead stock 15 near the cemented carbide chips 21*a* and 21*b* conforms to the shapes of the surfaces of the hard chips 5*a* and 5*b*, the material tends to flow along the most abraded portions of the cemented carbide chips 21*a* and 21*b* as indicated by arrows in FIG. 11(*c*) to further abrade the abraded portions of the cemented carbide chips 21*a* and 21*b*. Thus, the effect of the replacement of the hard chips 5*a* and 5*b* with each other for the extension of the life of the hard chips 5*a* and 5*b*, and the cemented carbide chips 21*a* and 21*b* is not as significant as expected.

SUMMARY OF THE INVENTION

Accordingly, it is an object of the present invention to provide a vertical impact crusher capable of preventing the concentrated abrasion of the middle portion of the stack of cemented carbide chips in the initial stage of use to extend the total life of the cemented carbide chips.

In one aspect of the present invention, a vertical impact crusher in accordance with the present invention comprises a rotor supported for rotation at a high rotating speed about a vertical axis, having discharge gates through which a material fed into the rotor is discharged, and a set of hard chips stacked one over the other at each discharge gate, and is characterized in that the upper and lower portions of the working surface of each hard chip project in the direction of rotation.

Since the upper and lower portions of the working surface of each of the new hard chips project in the direction of rotation of the rotor, the material flows along a recess formed between the upper and lower projecting portions of each hard chip, so that the middle portion of the stack of the hard chips is not subject to concentrated abrasion in the initial stage of use. When the hard chips are replaced with each other after the same have been abraded to some extent, the upper and lower portions of the stack of the hard chips still have a sufficiently large thickness. Since the section of the stack of the hard chips after the mutual replacement is not a smooth curve uniformly falling from the middle portion toward the upper and lower ends, the flow of the material toward the upper and lower portions of the stack of the hard chips is suppressed and, consequently, the stack of the hard chips is abraded comparatively uniformly.

BRIEF DESCRIPTION OF THE DRAWINGS

The above and other objects, features and advantages of the present invention will become more apparent from the following description taken in connection with the accompanying drawings, in which:

FIG. 10(*b*) is a side view of the cemented carbide chips of FIG. 9 after abrasion;

FIG. 10(*c*) is a side view of the cemented carbide chips of FIG. 9 after the same have been replaced with each other;

FIG. 11(*b* ) is a perspective view of the hard chips and the cemented carbide chips after abrasion, corresponding to FIG. 10(*b*); and FIG. 11(*c*) is a perspective view of the hard chips and the cemented carbide chips, corresponding to FIG. 10(*c*).

DESCRIPTION OF THE PREFERRED EMBODIMENT

Figure 1:
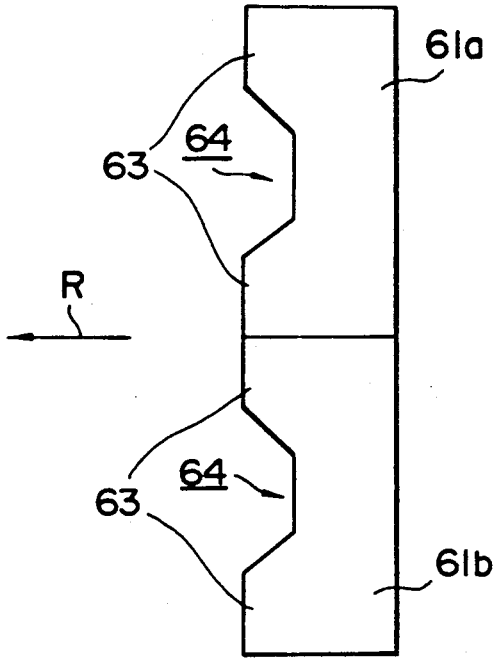
FIG. 1 is a side view of a stack of new hard chips embedded in hard chips employed in a vertical impact crusher in a preferred embodiment according to the present invention.

The present invention will be described hereinafter with reference to the accompanying drawings, in which parts like or corresponding to those previously described with reference to FIGS. 5 to 11(*c*) are be denoted by the same reference characters, and the description thereof will be omitted to avoid duplication.

A vertical impact crusher in accordance with the present invention is substantially identical in fundamental construction with the foregoing conventional vertical impact crusher 1, except that replaceable hard chips 5*a* and 5*b* stacked one over the other on a gate block 14 at each discharge gate 16 of a rotor included in the vertical impact crusher of the present invention are provided respectively with cemented carbide chips 61*a* and 61*b* each having upper and lower portions 63 projecting in the direction of rotation of the rotor 2 indicated by an arrow R and a recess 64 formed in its working surface between the projecting upper and lower portions 63 as shown in FIG. 1. The respective sections of the hard chips 5*a* and 5*b*, and the cemented carbide chips 61*a* and 61*b* are the same.

A material fed into the rotor 2 rotating at a high rotating speed about a vertical axis is guided by upper liners 3 and lower liners 4 toward the cemented carbide chips 61*a* and 61*b* embedded in the hard chips 5*a* and 5*b*. Then, the material accumulates in the vicinity of the hard chips 5*a* and 5*b* in a dead stock 15 of a shape conforming to the sectional shapes of the hard chips 5*a* and 5*b* and those of the cemented carbide chips 61*a* and 61*b*. Most of the material flows along portions of the dead stock 15 corresponding to the recesses 64 and the material is discharged through the discharge gates 16 of the rotor 2.

Figure 2:
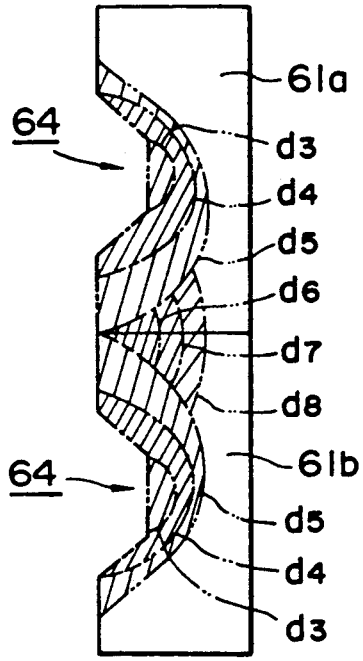
FIG. 2 is a side view of assistance in explaining the progress of abrasion of the stack of the cemented carbide chips of FIG. 1.

As the crushing operation is continued, the working surfaces of the cemented carbide chips 61*a* and 61*b* begins to be abraded first from the surfaces of the recesses 64 and the abraded area increases gradually as indicated at $d_3$, $d_4$ and $d_5$ in FIG. 2 with the progress of the crushing operation. The hard chips 5*a* and 5*b* are abraded in the similar manner. After the abraded areas in the cemented carbide chips 61*a* and 61*b* have joined as indicated at $d_5$ at the junction of the cemented carbide chips 61*a* and 61*b*, the working surfaces of the cemented carbide chips 61*a* and 61*b* are abraded rapidly as indicated at $d_6$, $d_7$ and $d_8$.

Figure 3:
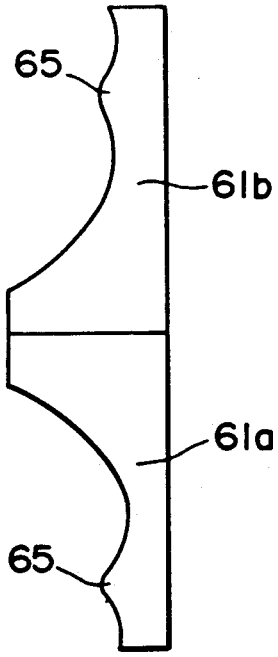
FIG. 3 is a side view of a stack of the cemented carbide chips of FIG. 1 formed by replacing the abraded cemented carbide chips with each other.
Figure 4:
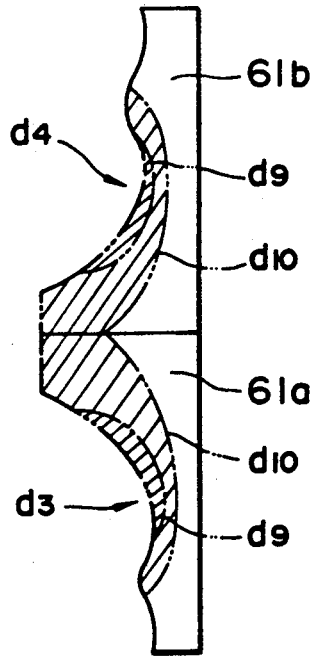
FIG. 4 is a side view of assistance in explaining the progress of abrasion of the stack of the abraded cemented carbide chips shown in FIG. 3.
Figure 5:
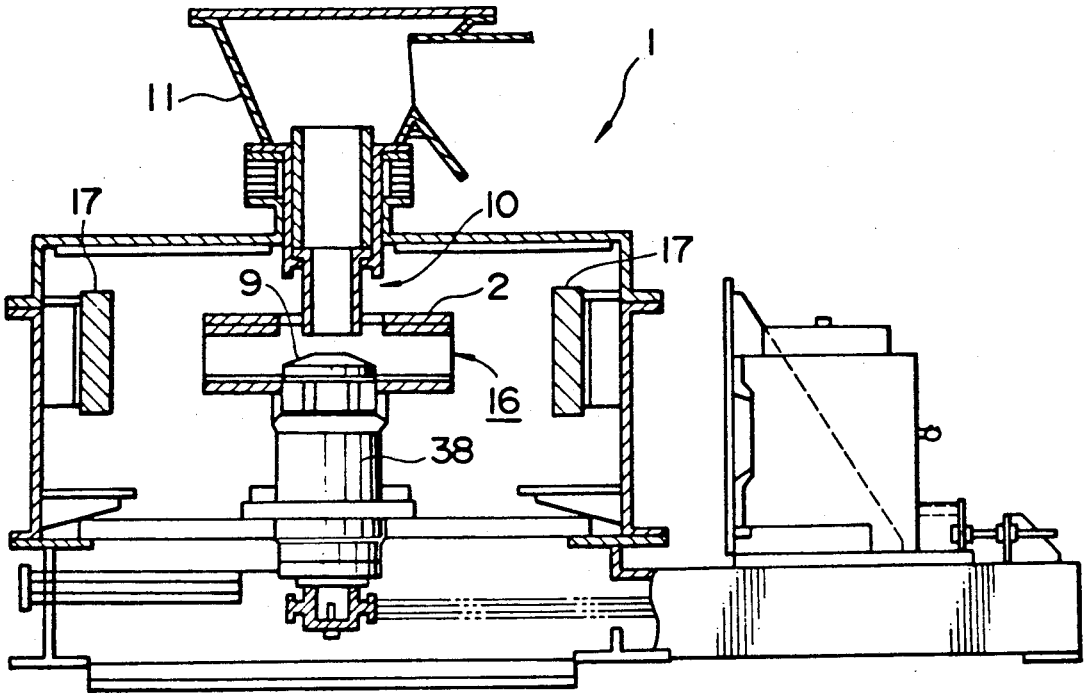
FIG. 5 PRIOR ART
FIG. 5 is a longitudinal sectional view of a conventional vertical impact crusher pertinent to the present invention.
Figure 6:
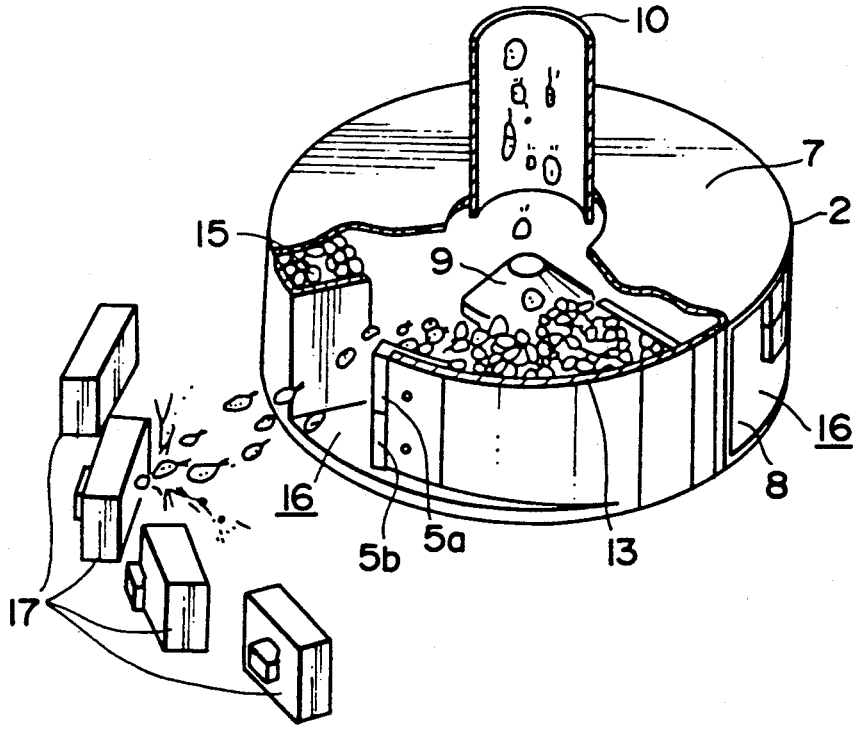
FIG. 6 PRIOR ART
FIG. 6 is a partially cutaway perspective view of the rotor of the vertical impact crusher of FIG. 5.
Figure 7:
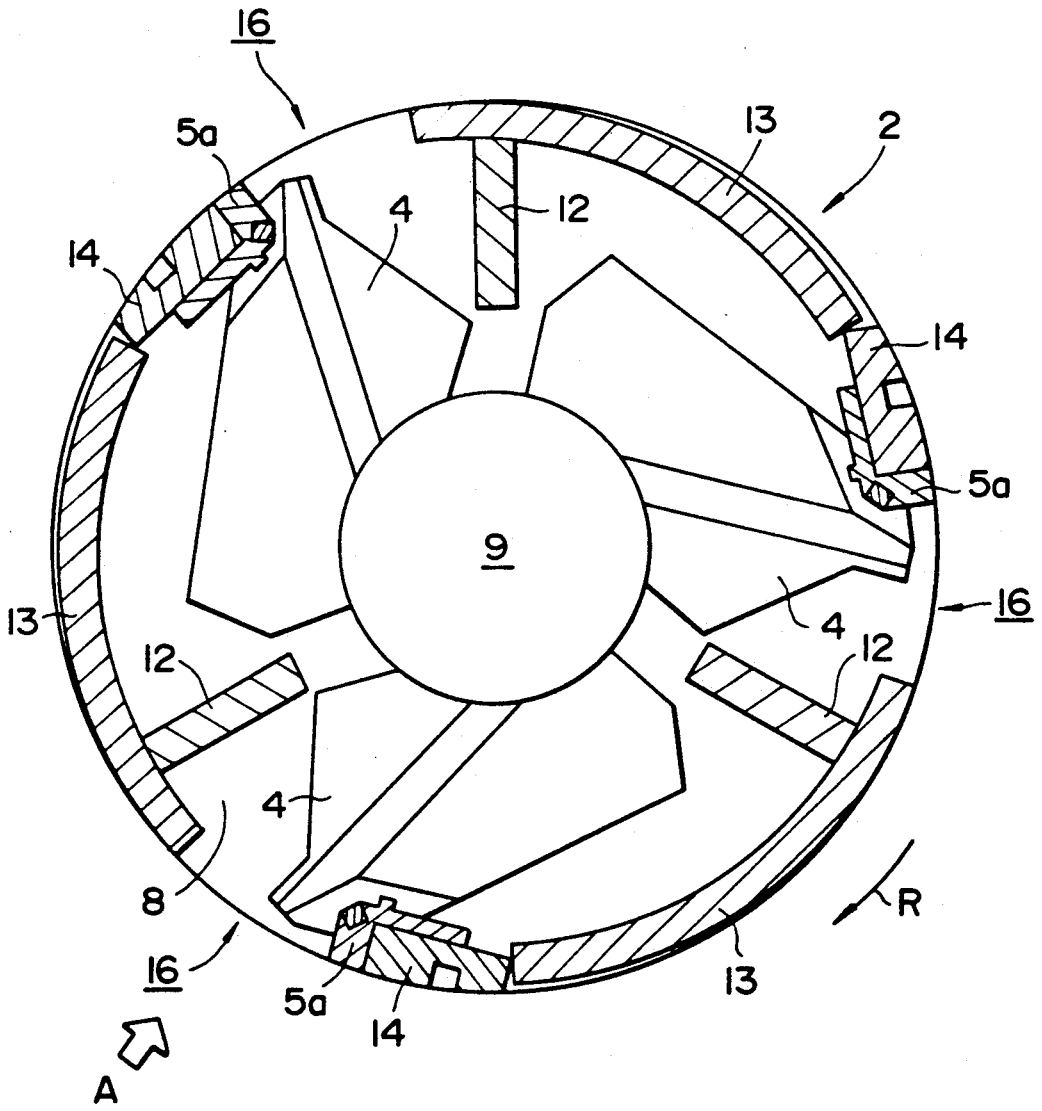
FIG. 7 PRIOR ART
FIG. 7 is a cross-sectional plan view of the rotor of FIG. 6.
Figure 8:
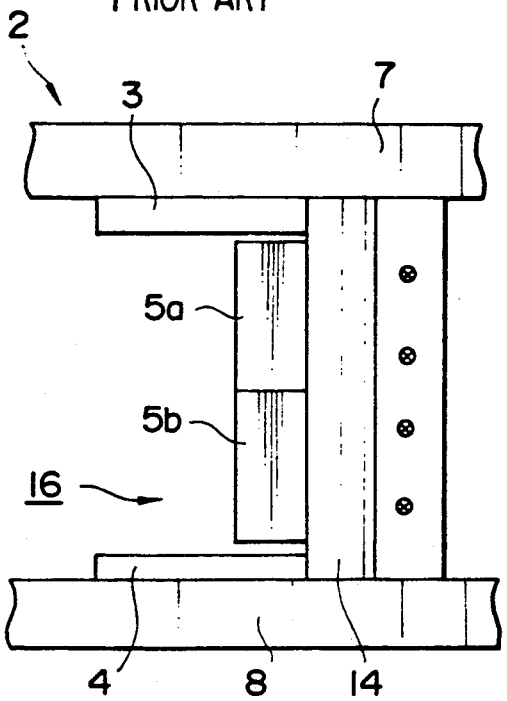
FIG. 8 PRIOR ART
FIG. 8 is a fragmentary side view of the rotor of FIG. 7, showing a portion of the same around a discharge gate.
Figure 9:
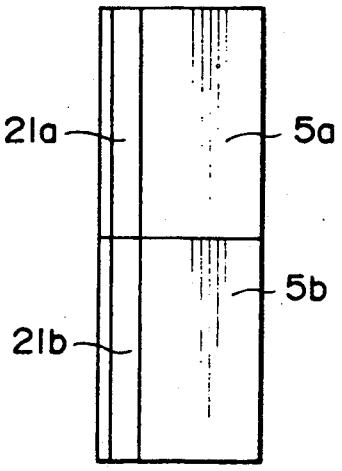
FIG. 9 PRIOR ART
FIG. 9 is a side view of a stack of hard chips respectively provided with cemented carbide chips, incorporated into the rotor of the conventional vertical impact crusher of FIG. 5.
Figure 10A:
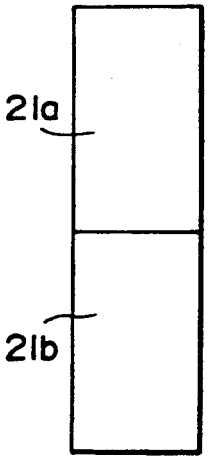
FIG. 10(a) PRIOR ART
FIG. 10(*a*) is a side view of the cemented carbide chips of FIG. 9 before use.
Figure 10B:
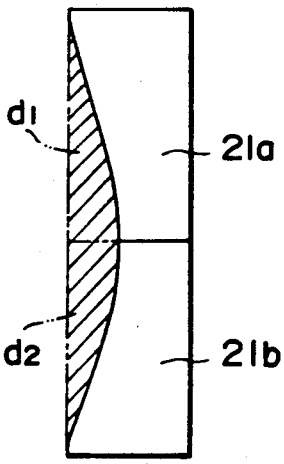
FIG. 10(b) PRIOR ART
Figure 10C:
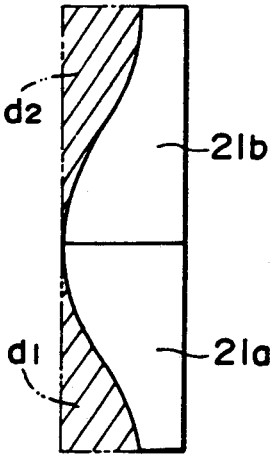
FIG. 10(c) PRIOR ART
Figure 11A:
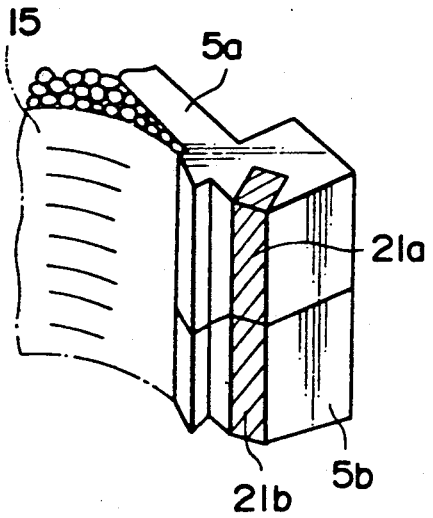
FIG. 11(a) PRIOR ART
FIG. 11(*a*) is a perspective view of the hard chips and the cemented carbide chips, corresponding to FIG. 10(*a*)
Figure 11B:
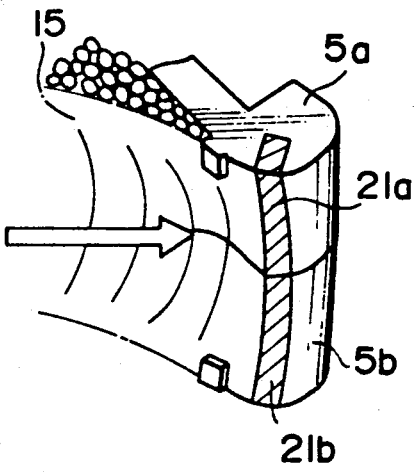
FIG. 11(b) PRIOR ART
Figure 11C:
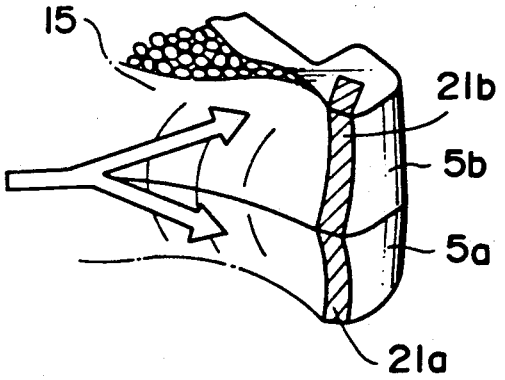
FIG. 11(c) PRIOR ART

Upon the abrasion of the cemented carbide chips 61*a* and 61*b* to an extent indicated at $d_8$, the hard chip 5*a* and 5*b* are replaced with each other to form a stack of the cemented carbide chips 61*a* and 61*b* as shown in FIG. 3. The stack of the cemented carbide chips 61*a* and 61*b* thus formed has a flat, thick middle portion and small protrusions 65 in portions respectively near the upper and lower ends of the stack, and the shape of the section of the stack of the cemented carbide chips 61*a* and 61*b* is not a curve smoothly falling from the middle portion toward the upper and lower ends.

During the crushing operation after the mutual replacement of the hard chips 5*a* and 5*b*, the material is able to flow along the middle portion of the stack of the cemented carbide chips 61*a* and 61*b*. Since the shapes of the upper and lower portions of the stack of the cemented carbide chips 61*a* and 61*b* are not uniform curves, the middle portion of the stack of the cemented carbide chips 61*a* and 61*b*, which is more subject originally to abrasive actions than other portions, is abraded at a rate of abrasion higher than that for other portions indicated at $d_9$ and $d_{10}$.

The cemented carbide chips 61*a* and 61*b* thus stacked one over the other are formed intentionally so as to guide the material, which is likely to be concentrated in the middle portion of the stack of the cemented carbide chips 61*a* and 61*b*, toward the upper and lower portions of the stack of the cemented carbide chips 61*a* and 61*b* in the initial stage of use of the cemented carbide chips 61*a* and 61*b*. Therefore, in the initial stage of use of the cemented carbide chips 61*a* and 61*b*, the working surfaces of the recesses 64 are abraded rapidly and hence the middle portion of the stack of the cemented carbide chips 61*a* and 61*b* is not subject to concentrative abrasion. When the cemented carbide chips 61*a* and 61*b* are replaced with each other after the same have been abraded to a certain extent, the abraded surfaces of the cemented carbide chips 61*a* and 61*b* form a working surface capable of suppressing the flow of the material toward the upper and lower portions of the working surface and of concentrating the flow of the material in the middle portion of the stack of the cemented carbide chips 61*a* and 61*b* having a comparatively large thickness. Thus, the cemented carbide chips 61*a* and 61*b* have an extended life longer than that of the conventional cemented hard chips. The hard chips 5*a* and 5*b* have the same advantages as well as the cemented carbide chips 61*a* and 61*b*.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A vertical impact crusher comprising:

a rotor supported for high speed rotation in a direction of rotation about a vertical axis, said rotor having at least one discharge gate through which a material fed to the rotor may be discharged;

a pair of hard chips at each said at least one discharge gate, said chips of each pair of chips being positioned adjacent one another in the vertical direction; and a pair of cemented carbide chips stacked on each said pair of hard chips, the upper and lower chips of each said pair of cemented carbide chips abutting one another in the direction of the vertical axis, each of said cemented carbide chips having upper and lower projecting portions which project in the direction of rotation to define a recess therebetween, wherein the upper projecting portion of the lower chip abuts the lower projecting portion of the upper chip and there are two of said recesses at each said at least one discharge gate, whereby the life of said cemented carbide chips may be improved if the positions of said chips are reversed when the cemented carbide chips are partially abraded.

2. The vertical impact crusher of claim 1, including a plurality of said discharge gates.

* * * * *